US011445766B1

(12) United States Patent
Vandal

(10) Patent No.: US 11,445,766 B1
(45) Date of Patent: Sep. 20, 2022

(54) INFANT DRYING BAG

(71) Applicant: Pamela Vandal, Oxford, FL (US)

(72) Inventor: Pamela Vandal, Oxford, FL (US)

( * ) Notice: Subject to any disclaimer, the term of this patent is extended or adjusted under 35 U.S.C. 154(b) by 178 days.

(21) Appl. No.: 16/996,982

(22) Filed: Aug. 19, 2020

(51) Int. Cl.
*A41B 13/06* (2006.01)
*A41D 31/12* (2019.01)

(52) U.S. Cl.
CPC ..... *A41B 13/06* (2013.01); *A41D 31/125* (2019.02)

(58) Field of Classification Search
CPC ..... A41B 13/06; A41D 31/125
See application file for complete search history.

(56) References Cited

U.S. PATENT DOCUMENTS 2,008,919 A * 7/1935 Milkes ..... A41B 13/06 2/69.5
2,324,665 A * 7/1943 Ayres ..... A41B 13/06 5/413 R
2,504,761 A * 4/1950 Turco ..... A47G 9/083 5/413 R
3,636,566 A * 1/1972 Sutherland ..... A41B 13/06 2/69.5
4,897,885 A * 2/1990 Lunt ..... A41B 13/06 2/69.5
6,389,597 B1 * 5/2002 Henegan ..... A41B 13/06 2/69.5
2006/0207024 A1 * 9/2006 Korshamn ..... A47G 9/08 5/413 R
2008/0229499 A1 * 9/2008 Narboni-Campora ..... A47G 9/068 5/413 R
2021/0030218 A1 * 2/2021 Schankel ..... A41B 13/06

* cited by examiner

*Primary Examiner* — Khaled Annis
(74) *Attorney, Agent, or Firm* — Gulf Coast Intellectual Property Group

(57) ABSTRACT

An infant drying bag configured to receive an infant therein so as to assist in the drying of an infant subsequent a bath. The infant drying bag includes a body wherein the body is formed from a first layer and a second layer. The body is rectangular in shape having a first longitudinal edge and a second longitudinal edge on opposing sides of the body. Proximate the lower end of the body is a lower peripheral edge. The first layer and second layer are joined along the first longitudinal edge, second longitudinal edge and the lower peripheral edge so as to form a cavity intermediate the first layer and second layer. The cavity is equivalent in size to the body and an opening is formed proximate the upper end of the body providing access to the cavity. The opening is defined by upper peripheral edges.

2 Claims, 2 Drawing Sheets

INFANT DRYING BAG

FIELD OF THE INVENTION

The present invention relates generally to infant hygiene and caretaking, more specifically but not by way of limitation, an infant drying bag that is configured to receive an infant in the interior volume thereof subsequent bathing of the infant.

BACKGROUND

As is known in the art, caring for an infant is an arduous task that requires the performance of many chores to ensure the infant is well cared for during the day and night. The aforementioned involves tasks such as but not limited to feeding, diaper changes and bathing. For the latter, many caretakers will bath infants and small children in specially accommodating bathtubs wherein the infant can be bathed and maintain a position that reduces potential harm to the infant. Ensuing the execution of the bath, the caretaker will lift the infant from the bathing apparatus and begin to dry the infant. This is typically done with a small towel wherein the towel is further manufactured from a soft absorbent material.

One problem with conventional infant towels is their inability to surroundably mount the infant during the drying process. As most infants are uncomfortable during the bathing or drying process, it is common for a caretaker to embrace the infant while drying the infant. The caretaker usually holds the infant against their torso in an attempt to keep the infant feeling secure and comfortable while also attempting to dry the infant. While performing the aforementioned with a conventional towel, the caretaker usually has the clothes they are wearing on their torso become wet due to the inability to completely wrap a moving infant in a conventional towel. This can be an inconvenience for the caretaker as well as result in some slight discomfort for the infant. Another issue with utilizing conventional towels is the inability to easily transition the infant from the bathtub to being completely covered with a towel. This process is quite cumbersome when utilizing a conventional towel.

Accordingly, there is a need for an infant drying bag that is configured to have an interior volume operable to receive an infant therein and subsequently be dried by a caretaker.

SUMMARY OF THE INVENTION

It is the object of the present invention to provide an infant drying bag that is operable to facilitate the drying of an infant subsequent the bathing thereof wherein the present invention includes a body having a first layer and a second layer.

Another object of the present invention is to provide an infant drying bag that is configured to dry an infant after a bath wherein the first layer includes four peripheral edges defining the shape thereof.

A further object of the present invention is to provide an infant drying bag that is operable to facilitate the drying of an infant subsequent the bathing thereof wherein the second layer includes four peripheral edges defining the shape thereof.

Still another object of the present invention is to provide an infant drying bag that is configured to dry an infant after a bath wherein the first layer and second layer are provided in the same size and shape.

An additional object of the present invention is to provide an infant drying bag that is operable to facilitate the drying of an infant subsequent the bathing thereof wherein the first layer and second layer are joined along three of the same peripheral edges so as to form a cavity intermediate the first layer and second layer.

Yet a further object of the present invention is to provide an infant drying bag that is configured to dry an infant after a bath wherein the body further includes an opening providing access to the cavity.

Another object of the present invention is to provide an infant drying bag that is operable to facilitate the drying of an infant subsequent the bathing thereof wherein the opening is generally aligned with the remaining peripheral edge of the first layer and second layer.

Still a further object of the present invention is to provide an infant drying bag that is configured to dry an infant after a bath wherein the body further includes a head portion, wherein the head portion extends upward from the opening and is configured to receive a portion of the infant's head therein.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
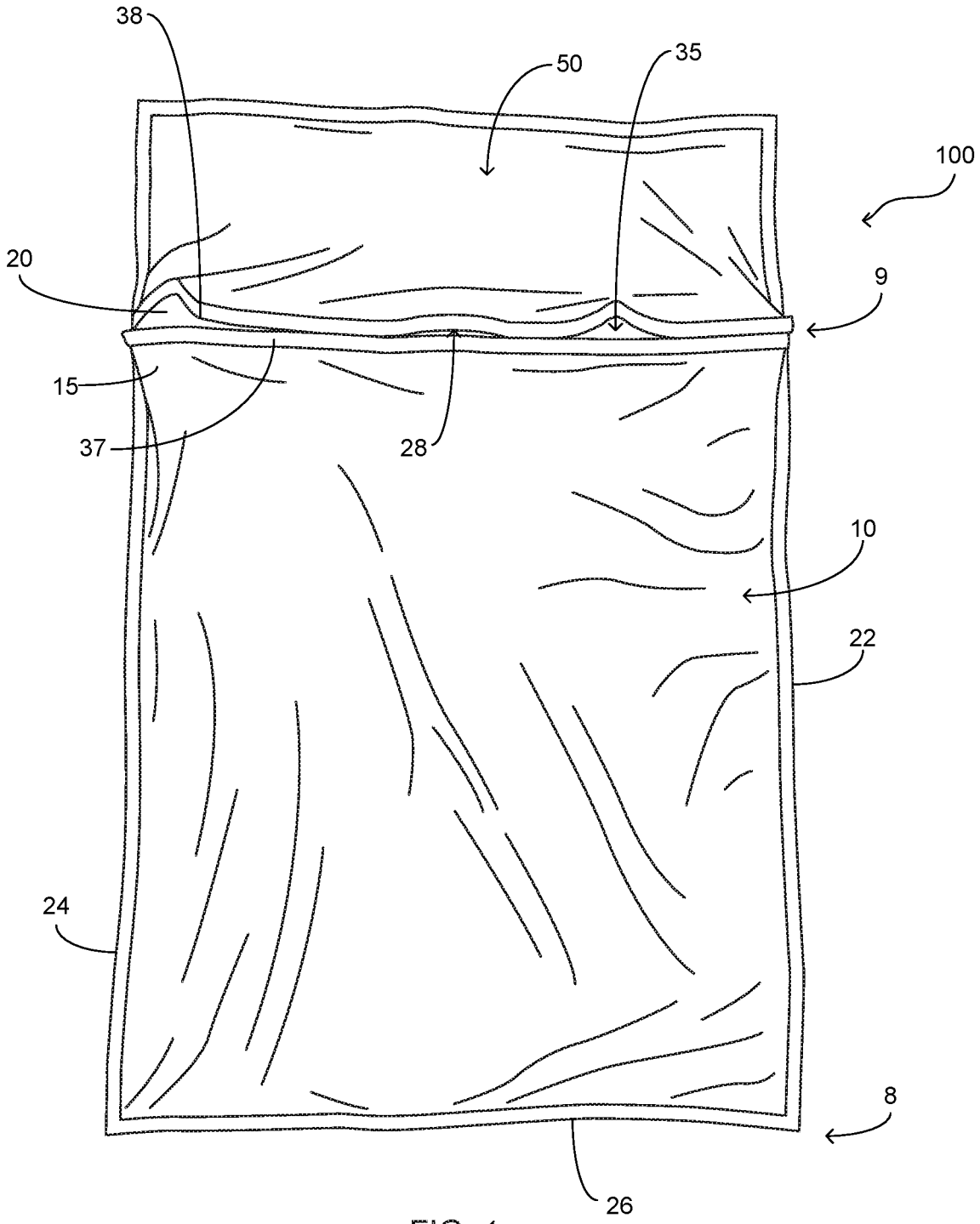
FIG. 1 is a front view of an embodiment of the present invention.

Referring now to the drawings submitted herewith, wherein various elements depicted therein are not necessarily drawn to scale and wherein through the views and figures like elements are referenced with identical reference numerals, there is illustrated an infant drying bag 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figure submitted herewith, the infant drying bag 100 includes a body 10. The body 10 is manufactured from a soft absorbent material such as but not limited to cotton. The body 10 is comprised of a first layer 15 and a second layer 20. The first layer 15 and second layer 20 are constructed to be of the same size and shape. While the body 10 is illustrated herein as being rectangular in shape, it should be understood within the scope of the present invention that the body 10 could be manufactured in alternate shapes and sizes.

The body 10 includes a first longitudinal edge 22 and a second longitudinal edge 24 wherein the first longitudinal edge 22 and second longitudinal edge 24 are on opposing sides of the body 10. A lower peripheral edge 26 is intermediate the first longitudinal edge 22 and second longitudinal edge 24 proximate the lower end 8 of the body 10. The first layer 15 and second layer 20 are joined along the first longitudinal edge 22, second longitudinal edge 24 and the lower peripheral edge 26 so as to form a cavity 35. The first longitudinal edge 22, second longitudinal edge 24 and the lower peripheral edge 26 are joined to form the cavity 35 utilizing suitable durable techniques such as but not limited to stitching. It should be understood within the scope of the present invention that the body 10 could be formed to create a cavity 35 through joining of all but one of the peripheral edges thereof. For the aforementioned, the body 10 could be formed in alternate shapes other than the preferred embodiment shape illustrated herein and further have more than four peripheral edges or as few as one peripheral edge. By way of example but not limitation, the body 10 could be annular in shape wherein the peripheral edge of the first layer 15 and second layer 20 could be joined with the exception of a portion thereof so as to create an opening and thus provide access to the cavity intermediate the first layer 15 and second layer 20.

Figure 2:
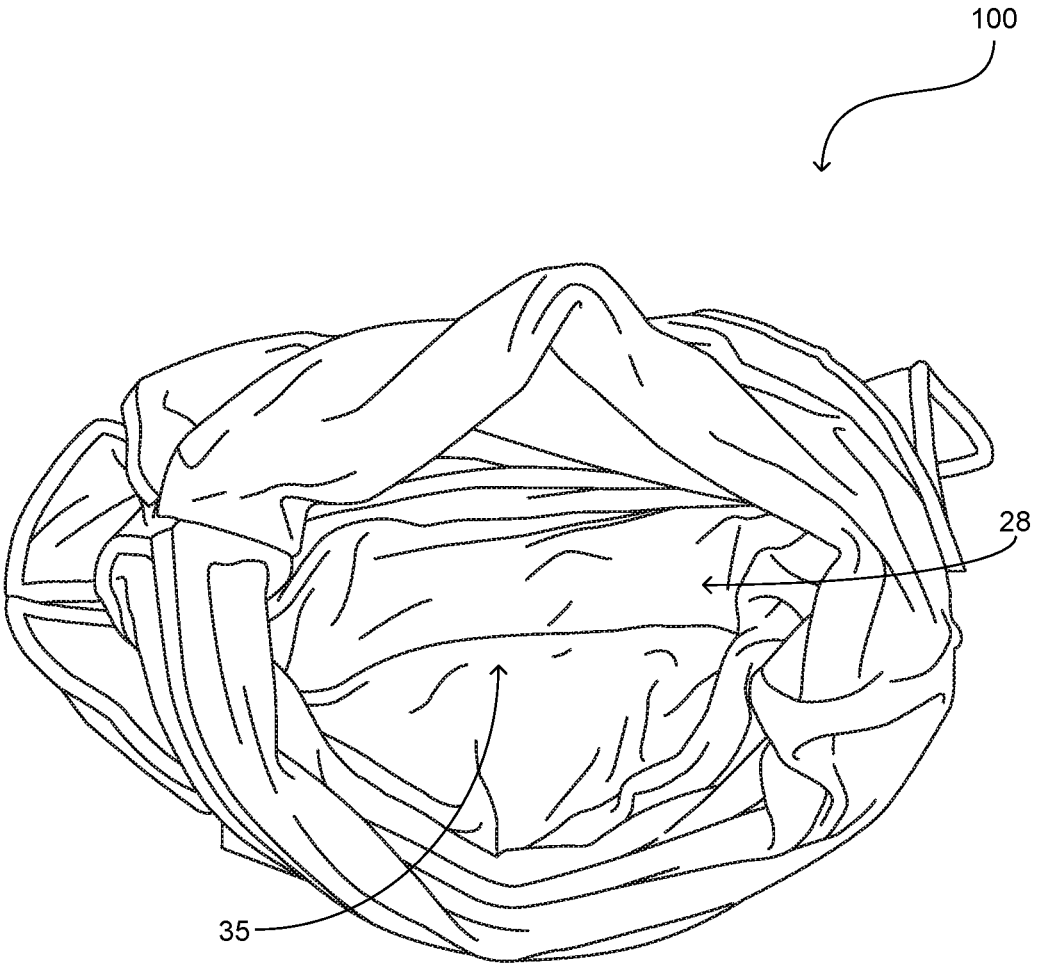
FIG. 2 is a top view of the present invention in position to have an infant placed therein.

Proximate the upper end 9 of the body 10 is the opening 28. The opening 28 provides access to the cavity 35 so as to allow a caretaker to place an infant substantially therein. As is illustrated herein in FIG. 2, the infant drying bag 100 is placed in a position wherein the opening 28 is spread open so as to provide easy access to the cavity 35. This can be executed ahead of bathing the infant wherein the infant drying bag 100 is placed on a suitable support surface adjacent to the bathing location. Placing the infant drying bag 100 in the position illustrated herein in FIG. 2 provides expedited placement of the infant into the cavity 35.

The opening 28 is defined by the first upper peripheral edges 37 and second upper peripheral edge 38 wherein the first upper peripheral edge 37 and second upper peripheral edge 38 are axially aligned and generally parallel. The first upper peripheral edge 37 is contiguous with the first layer 15. The second upper peripheral edge 38 is contiguous with the second layer 20. The aforementioned arrangement of the first upper peripheral edge 37 and second upper peripheral edge 38 ensure the formation of a cavity 35 that is capable of substantially enveloping an infant ensuing being disposed within the cavity 35 without the need for manipulation or arrangement of any portion of the body 10. The design of the body 10 of the present invention provides the ability to cover an infant's body from the neck down to the feet once placed in the cavity 35 of the body 10. It is contemplated within the scope of the present invention that the opening 28 could be formed in alternate sizes in order to achieve the desired objective stated herein.

Extending upward from the upper peripheral edge 38 is the head cover member 50. The head cover member 50 includes a first layer and second layer (not particularly illustrated herein) having a void therebetween so as to receive a portion of an infant's head ensuing being placed within the cavity 35 of the body 10. The head cover member 50 is rectangular in shape in a preferred embodiment as illustrated herein but it is contemplated within the scope of the present invention that the head cover member 50 could be formed in alternate shapes. By way of example but not limitation, the head cover member 50 could be oval in shape.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. An infant drying bag configured to dry an infant subsequent bathing wherein the infant is fully enveloped in the infant drying bag comprising:

a body, said body having an upper end and a lower end, said body having a first longitudinal edge and a second longitudinal edge, said first longitudinal edge and said second longitudinal edge being on opposing sides of the body, said body further having a lower peripheral edge, said lower peripheral edge being intermediate said first longitudinal edge and said second longitudinal edge, said lower peripheral edge being proximate the lower end of said body, said body having a first layer and a second layer, said second layer of said body having a length that is greater than that of said first layer of said body, said body having a cavity intermediate said first layer and said second layer, said first layer and said second layer of said body being stitched along said first longitudinal edge, said second longitudinal edge said lower peripheral edge, said body being rectangular in shape;

an opening, said opening being formed along an upper peripheral edge proximate said upper end of said body, said opening providing access to said cavity, said opening having a first upper peripheral edge and a second upper peripheral edge, said first upper peripheral edge being contiguous with said first layer, said second upper peripheral edge being contiguous with said second layer, said first upper peripheral edge and said second upper peripheral edge being generally parallel and axially aligned with each other so as to define said opening;

a head cover member, said head cover member being comprised of an upper portion of said first layer wherein the upper portion of the first layer is above said opening, said head cover member having opposing lateral edges stitched to said second layer of said body, said head cover member having a void between said upper portion and said second layer; and wherein said opening is sufficient in size for accommodating an infant therein and wherein said cavity is sufficient in size for covering an infant from a neck area to a foot area.

2. The infant drying bag as recited in claim 1, wherein said body is manufactured from an absorbent material.

* * * * *